US005839302A

United States Patent [19]

Chu

[11] Patent Number: 5,839,302

[45] Date of Patent: Nov. 24, 1998

[54] LOCKING DEVICE WITH TWO SIMULTANEOUSLY ACTUATED CYLINDRICAL PLUGS

[76] Inventor: Ching-Fa Chu, No. 17-3, Lane 144, Ho-Chiang St., Chang-Shan Dist., Taipei City, Taiwan

[21] Appl. No.: 868,014

[22] Filed: Jun. 3, 1997

[51] Int. Cl.[6] ..... E05B 67/24

[52] U.S. Cl. ..... 70/38 A; 70/39; 70/339

[58] Field of Search ..... 70/38 A, 38 R, 70/39, 337, 339, 233

[56] References Cited

U.S. PATENT DOCUMENTS

| | | | |
|---|---|---|---|
| 912,773 | 2/1909 | Augenbraun | 70/38 A |
| 2,834,195 | 5/1958 | Stackhouse | 70/339 |
| 3,581,530 | 6/1971 | Raspadori | 70/38 R |
| 3,808,984 | 5/1974 | Teleky | 70/339 X |
| 4,216,664 | 8/1980 | Slavinsky | 70/339 X |
| 4,332,153 | 6/1982 | Miles | 70/339 |
| 4,351,171 | 9/1982 | Tsui | 70/339 |
| 4,655,062 | 4/1987 | Kaufman | 70/339 |
| 5,189,893 | 3/1993 | Kortenbrede | 70/38 A |
| 5,417,092 | 5/1995 | Iu | 70/38 A |
| 5,640,861 | 6/1997 | Chen | 70/38 A |
| 5,720,191 | 2/1998 | Tsung-Chuan et al. | 70/38 A |
| 5,727,407 | 3/1998 | Cowen | 70/339 X |

FOREIGN PATENT DOCUMENTS

| | | | |
|---|---|---|---|
| 182600 | 2/1918 | Canada | 70/38 A |
| 356951 | 8/1922 | Germany | 70/39 |

*Primary Examiner*—Suzanne Dino Barrett

*Attorney, Agent, or Firm*—Townsend and Towsend and Crew LLP

[57] ABSTRACT

A locking device includes a lock body with two blind bores and a shackle with two parallel arms for insertion into the bores. The lock body further includes two key-actuated cylindrical plugs, an accommodation chamber disposed therein proximate to the plugs, and a linkage member provided within the chamber to interlink the plugs in such a manner that only simultaneous actuation of the cylindrical plugs can retract the spring-loaded latch bolts to release the shackle from the blind bores of the lock body.

6 Claims, 5 Drawing Sheets

LOCKING DEVICE WITH TWO SIMULTANEOUSLY ACTUATED CYLINDRICAL PLUGS

BACKGROUND OF THE INVENTION

1. Field of the Invention

The invention relates to a locking device, more particularly to a locking device which includes two interlinked key-actuated cylindrical plugs that must be simultaneously actuated to open the locking device.

2. Description of the Related Art

A conventional locking device, such as a pedal lock for securing the wheel of a motorbike, includes a lock body with two blind bores formed in an upper portion thereof and a shackle which has a left end portion and a right end portion that are insertable into the blind bores so as to be engaged therein such that the lock body and the shackle form a closed connection therebetween.

A drawback of the conventional locking device lies in that the lock body can be easily picked by an elongated flexible stick so as to rotate a plug unit thereof, thereby resulting in disengagement of one or both of the end portions of the shackle from the blind bores of the lock body.

SUMMARY OF THE INVENTION

The object of this invention is to provide a locking device which includes a shackle and a lock body that is adapted to receive two end portions of the shackle and that is formed with two interlinked key-actuated cylindrical plugs that must be simultaneously actuated to open the locking device, thereby preventing the locking device from being picked.

Accordingly, the locking device of this invention includes a lock body and a shackle which has a left free end and a right free end laterally opposed to and spaced from the left free end. The lock body includes an upper portion that defines left and right blind bores for respective insertion of the left and right free ends of the shackle so as to form a closed connection therebetween, and a lower portion that defines left and right elongated cavities respectively extending towards the upper portion and terminating to form left and right boundary walls. The boundary walls are transverse to and are disposed between the left and right blind bores, and define left and right through holes respectively. An accommodation chamber is interposed between the upper portion of the lock body and both of the left and right boundary walls so as to communicate the elongated cavities via the through holes. Two left and right key-actuated cylindrical plugs are disposed respectively in the left and right elongated cavities and are rotatable respectively around longitudinal axes relative to the corresponding cavity when the cylindrical plugs are actuated. Each of the cylindrical plugs has a proximate end and a distal end relative to the boundary walls. Left and right cam members are disposed on the proximate ends of the cylindrical plugs respectively and extend out of the corresponding through hole into the accommodation chamber. The cam members are rotatable with the left and right cylindrical plugs respectively around the longitudinal axes. When the cam members are rotated with the cylindrical plugs, spring-loaded left and right latch bolts are respectively retracted from being latched with the left and right free ends of the shackle. A linkage member is disposed in the accommodation chamber to couple the left and right cam members respectively at positions radially offset from the corresponding longitudinal axis so as to guard against any attempt to rotate only one of the cylindrical plugs.

Since only simultaneous rotation of the cylindrical plugs can release the shackle from the blind bores of the lock body, it is difficult to pick the locking device of this invention.

BRIEF DESCRIPTION OF THE DRAWINGS

Other features and advantages of this invention will become apparent in the following detailed description of the preferred embodiment of this invention, with reference to the accompanying drawings, in which.

DETAILED DESCRIPTION OF THE PREFERRED EMBODIMENT

Figure 1:
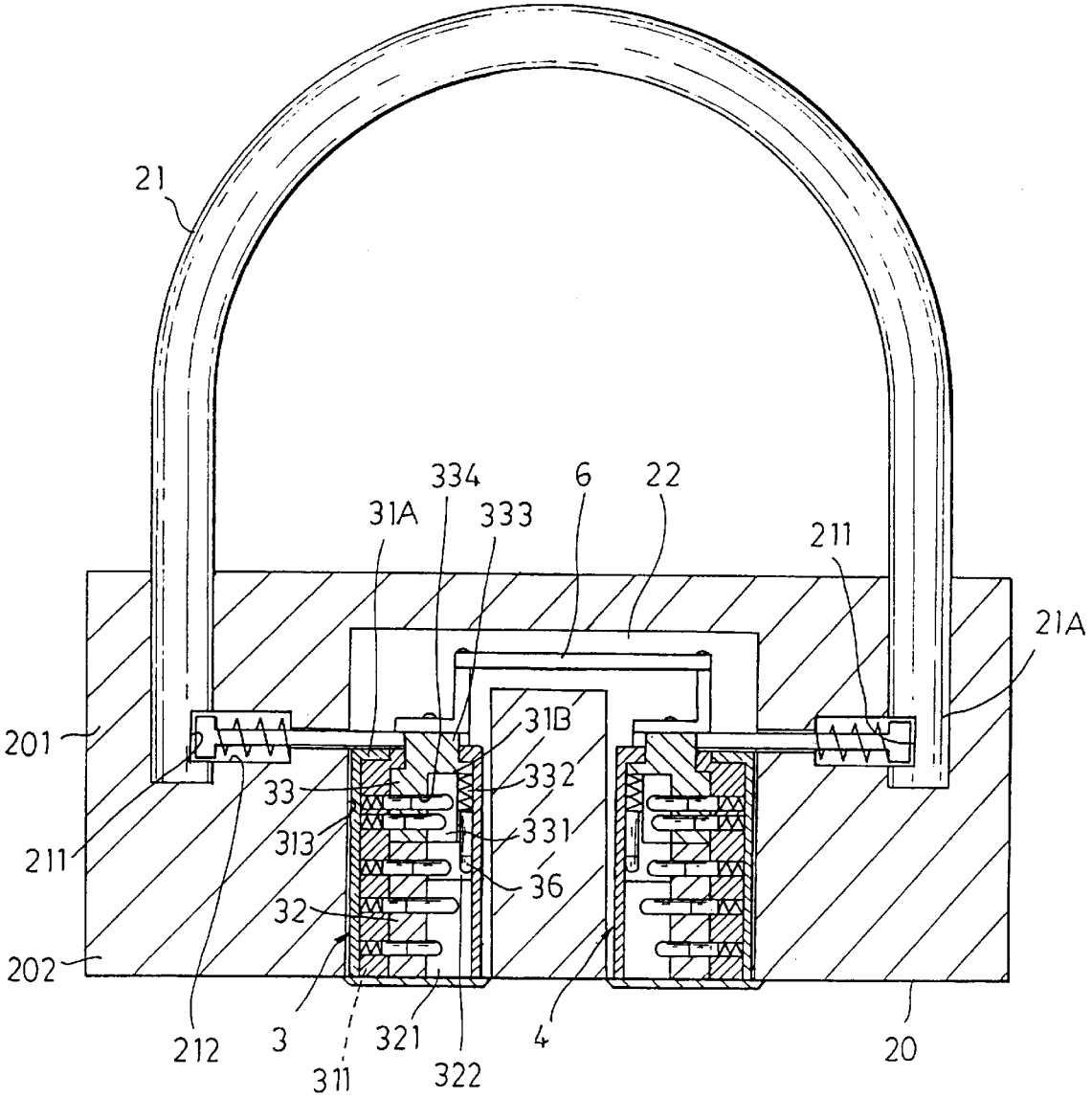
FIG. 1 is a partly cross sectional view of the preferred embodiment of a locking device according to this invention.

Before the present invention is described in greater detail, it should be noted that same reference numerals have been used to denote like elements throughout the disclosure.

Figure 2:
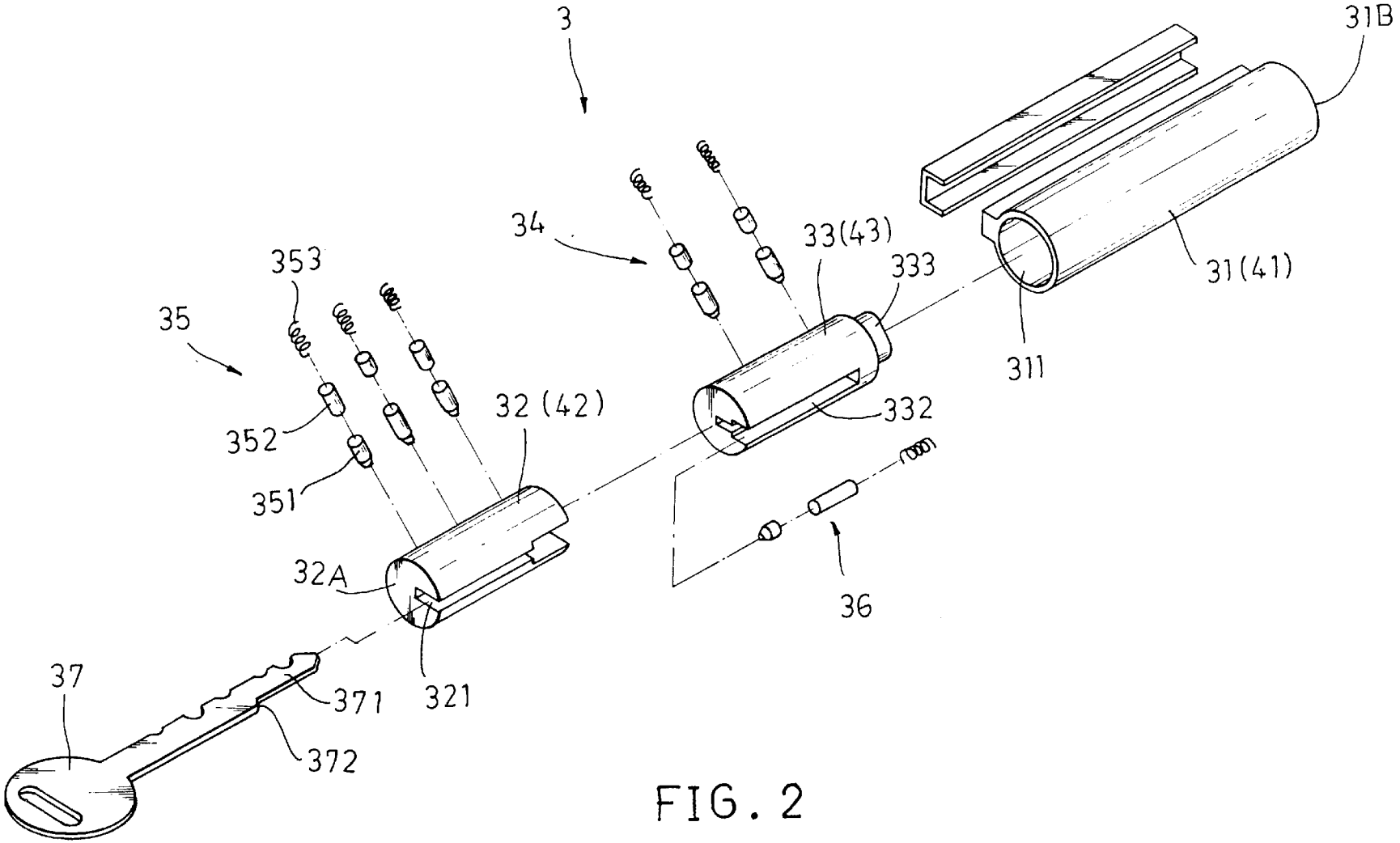
FIG. 2 is an exploded view of a cylindrical plug of the preferred embodiment.

Referring to FIGS. 1 and 2, the preferred embodiment of a locking device of the invention is shown to include a lock body 20 and a shackle 21.

As illustrated, the shackle 21 is generally U-shaped and has left and right parallel arms 21A which are formed with two engagement grooves 211 respectively adjacent to left and right free ends thereof. The lock body 20 includes an upper portion 201 that defines left and right blind bores 212 for respective insertion of the left and right free ends of the shackle 21 so as to form a closed connection therebetween. Two hollow cylinder casings 31, 41 (see FIG. 2) are embedded securely in the lower portion 202 of the lock body 20 to define left and right elongated cavities 311 for accommodation of left and right cylindrical plugs 3, 4. Each of the cylinder casings 31, 41 has an outer end which is generally flush with an external surface of the lock body 20, and an inner end which extends toward the upper portion 201 and which terminates at an intermediate portion of the lock body 20 to form left and right boundary walls 31A. The boundary walls 31A are transverse to and are disposed between the left and right blind bores 211, and define left and right through holes 31B respectively. The lock body 20 further has an accommodation chamber 22 interposed between the upper portion 201 and both of the left and right boundary walls 31A so as to communicate the elongated cavities 311 via the through holes 31B. The left and right cylindrical plugs 3, 4 which consist of first and second plug bodies (32, 33), (42, 43), are disposed respectively in the left and right elongated cavities 311. When actuated by a corresponding inserted key 37, the plug bodies (32, 33), (42, 43), are rotatable respectively about the longitudinal axes of the cylinder casings 31, 41. Each of the cylindrical plugs 3, 4 has a proximate end 333, 433 (see FIG. 3) extending into the accommodation chamber 22 via the through hole 31B of the boundary wall 31A. An elongated keyway, consisting of a first section 321 and a second section 332, is formed in each of the cylindrical plugs 3, 4 and extends from a distal end 32A of the first plug body 32, 42 into the second plug body 33, 43. Each of the cylindrical plugs 3, 4 is further provided with two radially extending spring-loaded tumbler units 34, 35 such that the cylindrical plugs 3, 4 are non-rotatable relative to the cylinder casings 31, 41 in a normal condition, and one axially extending spring-loaded tumbler unit 36, the purpose of which will be described later.

Note that the left and right cylindrical plugs 3, 4 can be constructed in different structures if desired. In the preferred embodiment, since the left and right plugs 3, 4 are identical in structure, two identical keys 37 will be required to actuate the same.

Figure 3:
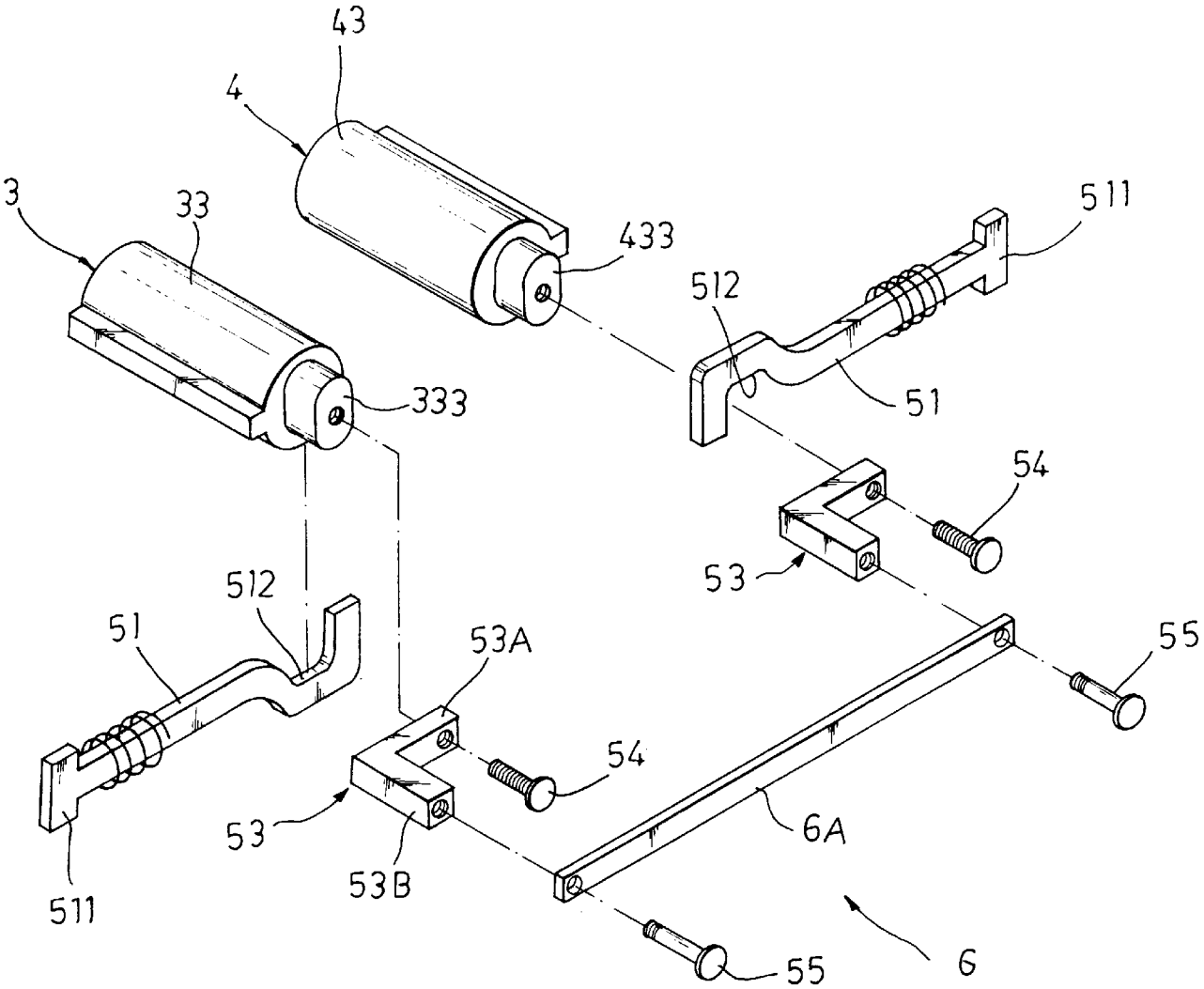
FIG. 3 illustrates how a linkage member of the preferred embodiment interlinks two cylindrical plugs.

Referring to FIG. 3 and in combination with FIG. 1, the left and right cylindrical plugs 3, 4 are interlinked by a linkage member 6 which includes an elongated rod 6A that is transverse to the longitudinal axes of the cylindrical plugs 3, 4, and two L-shaped connecting rods 53. The connecting rods 53 include two first ends 53A connected fixedly to the proximate ends 333, 433 of the cylindrical plugs 3, 4 by means of two screws 54, and two second ends 53B connected pivotally to two opposed ends of the elongated rod 6A respectively by the use of two pivots 55 such that the pivots 55 are radially offset from the longitudinal axes of the cylinder casings 31, 41 (see FIG. 2). Each of the spring-loaded latch bolts 51 has an inner hooked portion 512 buckled around the proximate end 333, 433 of the respective cylindrical plug 3, 4 and an engagement portion 511 that extends into the corresponding engagement groove 211 of the shackle 21 (see FIG. 1) to prevent disengagement thereof.

Figure 4:
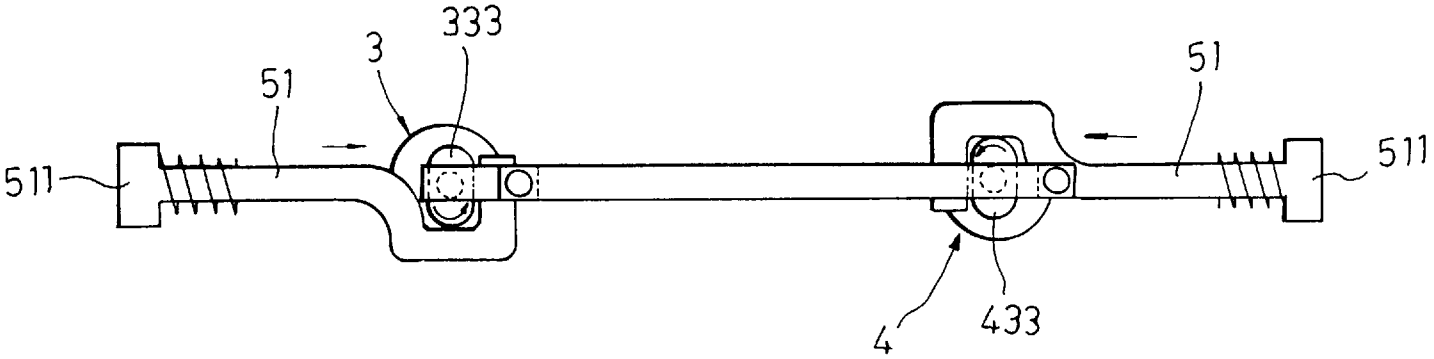
FIG. 4 illustrates how simultaneous rotation of the cylindrical plugs retracts two spring-loaded latch bolts, wherein the lock body and the shackle of the preferred embodiment are removed for the sake of clarity.
Figure 5:
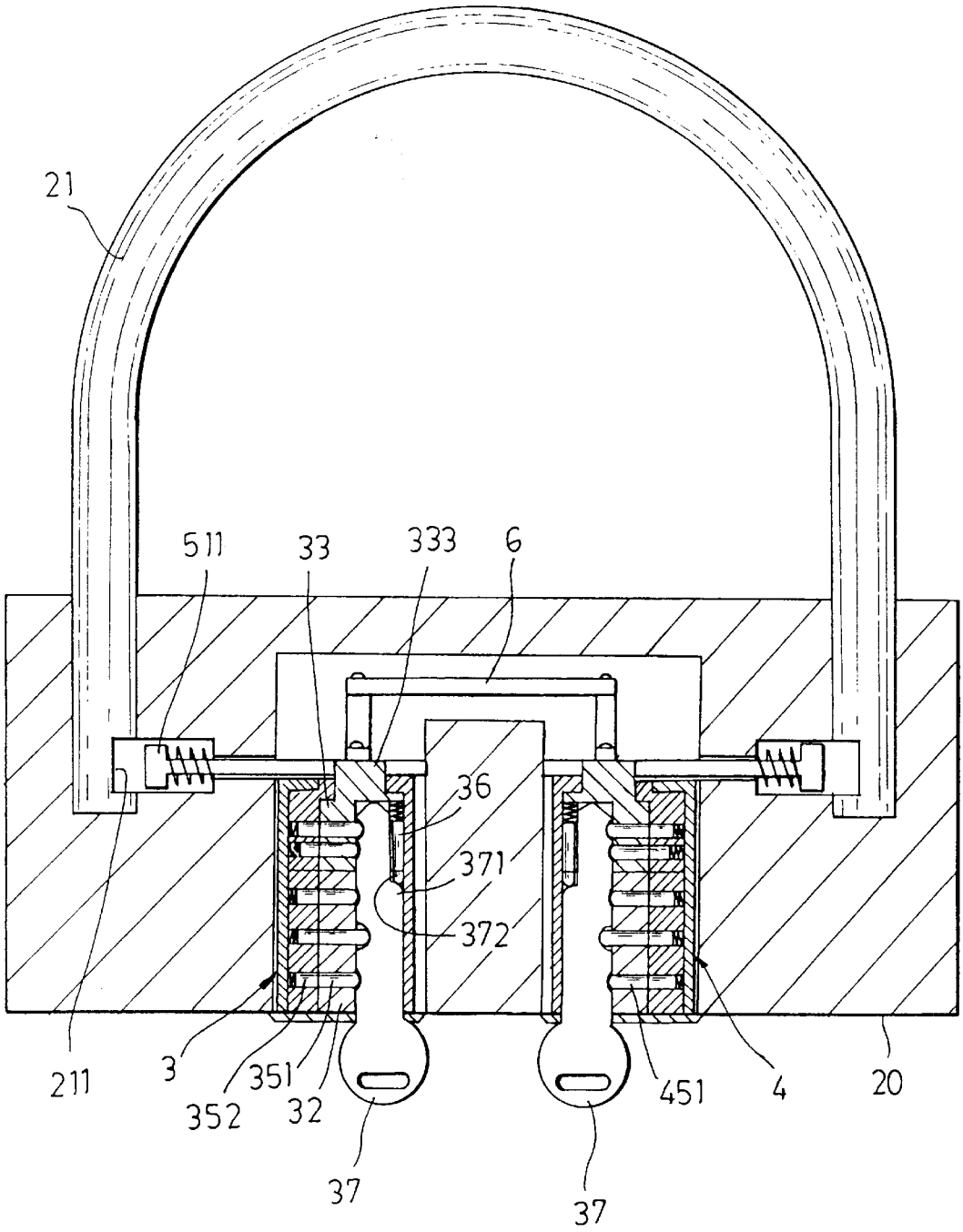
FIG. 5 is a partly cross sectioned view of the preferred embodiment, wherein the latch bolts are retracted so as to release the shackle via simultaneous rotation of the cylindrical plugs.

Referring to FIGS. 4 and 5, when two keys 37 are inserted into the keyways 321, 332 (see FIG. 2) of the left and right cylindrical plugs 3, 4, the axially extending tumbler units 36 (see FIG. 2) are simultaneously compressed inwardly by the abutment faces 372 of the keys 37 such that the shanks 371 of the keys 37 can raise the segments 351 of the radially extending tumbler units 34, 35 from the bores 334 of the plug bodies 32, 33 (see FIG. 1) against action of the biasing members 353 (see FIG. 2). Under this condition, adjoining faces of the two segments 351, 352 of the radially extending tumblers units 34, 35 are flush with the external surfaces of the plug bodies 32, 33, thereby permitting rotation of the cylindrical plugs 3, 4 about the longitudinal axes of the cylinder casings 31, 41 (see FIG. 2). Rotation of the cylindrical plugs 3, 4 retracts the spring-loaded latch bolts 51 from the engagement grooves 211 of the shackle 21 and correspondingly releases the shackle 21 from the lock body 20. In this preferred embodiment, the proximate ends 333, 433 of the cylindrical plugs 3, 4 serve as cam members because they can convert the rotation of the plug bodies 32, 33 into linear movements of the spring-loaded latch bolts 51.

In case only one key is inserted, the corresponding plug will be prevented from rotation by the linkage member. Only simultaneous rotation of the cylindrical plugs can release the shackle from the blind bores of the lock body. As such, it is difficult to pick the two cylindrical plugs synchronously by using only two hands since one hand will be required to hold the lock body while the other hand holds the pick, thereby preventing picking of both of the cylindrical plugs.

With this invention thus explained, it is apparent that numerous modifications and variations can be made without departing from the scope and spirit of this invention. It is therefore intended that this invention be limited only as indicated in the appended claims.

I claim:

1. A locking device comprising:

a shackle having a left free end and a right free end which are laterally opposed to and spaced from each other;

a lock body having:

an upper portion defining left and right blind bores for respective insertion of said left and right free ends so as to form a closed connection with said shackle, a lower portion defining left and right elongated cavities respectively extending towards said upper portion and terminating to form left and right boundary walls which are transverse to and disposed between said left and right blind bores, said boundary walls defining left and right through holes respectively, and an accommodation chamber interposed between said upper portion and both of said left and right boundary walls, said chamber being communicated with said elongated cavities via said through holes;

left and right key-actuated cylindrical plugs disposed respectively in said left and right elongated cavities and rotatable respectively around a corresponding longitudinal axis relative to said corresponding cavity when actuated, each of said cylindrical plugs having a proximate end and a distal end relative to a corresponding one of said boundary walls;

left and right cam members disposed on said proximate ends of said cylindrical plugs respectively and extending out of said through holes into said accommodation chamber, said cam members being rotated with said left and right cylindrical plugs respectively around said longitudinal axes;

left and right spring-loaded latch bolts respectively and transversely disposed and driven to retract from being latched with said left and right free ends of said shackle respectively by said left and right cam members when said cam members are rotated with said cylindrical plugs; and a linkage member disposed in said accommodation chamber to couple said left and right cam members respectively at positions radially offset from said longitudinal axes so as to guard against any attempt to rotate only one of said cylindrical plugs.

2. The locking device as defined in claim 1, wherein said linkage member includes an elongated rod extending transversely to said longitudinal axes of said cylindrical plugs, and two connected rods respectively having a first end connected fixedly to a respective one of said cam members and radially offset from a respective one of said longitudinal axes and a second end connected pivotally to one of two opposed ends of said elongated rod.

3. The locking device as defined in claim 1, wherein said shackle is generally U-shaped, and said left and right free ends extend parallel to each other.

4. The locking device as defined in claim 2, wherein said left and right free ends have two engagement grooves respectively to receive and retain said left and right latch bolts respectively when said left and right free ends are extended into said blind bores of said lock body.

5. The locking device as defined in claim 1, wherein said lock body further includes two hollow cylinder casings respectively disposed in said elongated cavities in such a manner to receive said cylindrical plugs therein, and two tumbler sets respectively disposed between adjacent pair of said cylinder casing and said cylindrical plug to prevent rotation of said cylindrical plug relative to said cylinder casing.

6. The locking device as defined in claim 1, wherein each of said cylinder casings has an outer end generally flush with an external surface of said lower portion of said lock body, and an inner end disposed proximate to said accommodation chamber and serving as said boundary wall.

* * * * *